US006339408B1

(12) United States Patent
Edvardsson et al.

(10) Patent No.: US 6,339,408 B1
(45) Date of Patent: Jan. 15, 2002

(54) ANTENNA DEVICE COMPRISING FEEDING MEANS AND A HAND-HELD RADIO COMMUNICATION DEVICE FOR SUCH ANTENNA DEVICE

(75) Inventors: Olov Edvardsson, Taby; Richard Bohannan, Långås, both of (SE); Thierry Bousquet, Clamart (FR)

(73) Assignee: Allgen AB, Akersberga (SE)

( * ) Notice: Subject to any disclaimer, the term of this patent is extended or adjusted under 35 U.S.C. 154(b) by 0 days.

(21) Appl. No.: 09/312,497

(22) Filed: May 17, 1999

(30) Foreign Application Priority Data

May 18, 1998 (SE) ..... 9801753

(51) Int. Cl.[7] ..... H01Q 1/36
(52) U.S. Cl. ..... 343/895; 343/702
(58) Field of Search ..... 343/895, 702, 343/700 MS, 853, 860, 778, 906; H01Q 1/36

(56) References Cited

U.S. PATENT DOCUMENTS

| | | | | |
|---|---|---|---|---|
| 4,554,554 A | * | 11/1985 | Olesen et al. | 343/895 |
| 5,134,422 A | * | 7/1992 | Auriol | 343/895 |
| 5,198,831 A | | 3/1993 | Burrell et al. | 343/895 |
| 5,572,224 A | | 11/1996 | Moller et al. | 343/702 |
| 5,594,461 A | * | 1/1997 | O'Neill, Jr. | 343/895 |
| 5,628,057 A | | 5/1997 | Phillips et al. | 455/89 |
| 5,650,792 A | * | 7/1997 | Moore et al. | 343/725 |
| 5,708,445 A | | 1/1998 | Moller et al. | 343/702 |
| 5,920,292 A | * | 7/1999 | O'Neill, Jr. | 343/895 |
| 5,963,180 A | * | 10/1999 | Leisten | 343/895 |
| 6,005,521 A | * | 12/1999 | Suguro et al. | 343/700 MS |
| 6,034,650 A | * | 3/2000 | Kuramoto | 343/895 |
| 6,075,501 A | * | 6/2000 | Kuramoto et al. | 343/895 |
| 6,094,178 A | * | 7/2000 | Sanford | 343/895 |

FOREIGN PATENT DOCUMENTS

| | | |
|---|---|---|
| EP | 0320404 | 6/1989 |
| FR | 2746547 | 9/1997 |
| FR | 2746548 | 9/1997 |
| WO | WO97/11507 | 3/1997 |
| WO | WO97/35356 | 9/1997 |
| WO | WO97/35357 | 9/1997 |

* cited by examiner

*Primary Examiner*—Don Wong
*Assistant Examiner*—Trinh Vo Dinh
(74) *Attorney, Agent, or Firm*—Jacobson Holman, PLLC

(57) ABSTRACT

The object of the present invention is to achieve an easily mounted antenna device for receiving and/or transmitting circular polarized RF signals in at least one and preferably two frequency bands with a well defined interface towards the circuitry in the hand-held mobile communication device. This is obtained by providing N radiating elements where N is an integer greater than one, a support means arranged to support said radiating elements, a housing, and at least one connection member arranged to be easily connectable to a circuitry on a first printed circuit carrier arranged in said hand-held mobile communication device. Further more, providing at least one phasing network comprising N first ports arranged to be connected to said radiating elements and at least one second port arranged to be connected to said connection member, said phasing network being mounted to said support.

10 Claims, 11 Drawing Sheets

ANTENNA DEVICE COMPRISING FEEDING MEANS AND A HAND-HELD RADIO COMMUNICATION DEVICE FOR SUCH ANTENNA DEVICE

TECHNICAL FIELD OF INVENTION

The present invention relates to an antenna device comprising feeding means and an hand-held mobile communication device comprising such an antenna, in general, and more specifically to an antenna device comprising feeding means and an hand-held mobile communication device comprising such an antenna for receiving and transmitting circular polarized RF signals for communication via satellites.

DESCRIPTION OF RELATED ART

Hand-held satellite communication devices, using satellites as a first link in the communication, is being increasingly popular and fulfills a demand for communication in unpopulated areas where ordinary cellular type of mobile communication is not possible due to, for instance, economy.

Hand-held satellite communication devices uses circular polarized RF signals for communication with the satellite since it is not possible to know how the satellite is oriented in space. The use of circular polarized RF signals puts somewhat different requirements on the antennas for such devices as compared with ordinary cellular antennas. A commonly used solution uses a quadrofilar antenna comprising four helical radiating elements coaxially arranged and coextending, each fed with 90° phase difference. The antenna is contained in a cylindrical housing. For optimal performance it is also common to have some sort of matching means between the antenna and the hand-held mobile communication device.

When a manufacturer of hand-held mobile communication devices assembles a device, it is of course important that the assembly is as smooth as possible and the number of steps in the assembly is as few as possible. This is advantageously since each step, by itself, introduces a possible fault in the process. It is a desired feature of assembly processes to have a block structure where several building blocks is assembled and tested separately to find faulty building blocks and that the building blocks then are assembled into bigger building blocks to finally be assembled to the complete product. In the assembly process the antenna is one such part that will be assembled onto the hand-held device and connected to the circuitry of the hand-held device.

It is desired that the number of steps for assembling the antenna device onto the hand-held mobile communication device is kept low. For a quadrofilar helical antenna device QHA, as described above, the number of radiating elements to be connected are four, and it would of course be advantageously if this could be reduced. The more general NHA denotes a N-filar helical antenna where N is the number of radiating elements and is greater than one.

If the hand-held mobile communication device is required to receive and/or transmit in two frequency bands with a relatively large separation the common solution has been to use two different antennas tuned to each separate frequency. This results in eight wires to connect from the radiating elements to the circuitry of the hand-held communication device.

A such antenna is disclosed in the French application FR-2746548, by France Telecom, where a dual band antenna is disclosed having two independent quadrifilar helical antenna elements. Each of these antenna elements operate in a specific frequency band and have separate phasing networks. Each antenna element is manufactured on a flexible substrate which is mounted on a cylindrical substrate, a first on the inside and a second on the outside. The construction of this antenna is complicated, require two antenna elements, and is expensive to manufacture, and furthermore have an unwanted high height.

If only one antenna is to be used it is required to use specific circuits in the hand-held mobile communication device which is selected according to the specific characteristics of the selected- antenna. It is of course a problem for an independent manufacturer of hand-held communication devices if it is necessary to add specific circuitry in dependence of the antenna supplier currently selected.

It would thus be an advantage if the interface between the hand-held device and the antenna could be made simple.

The PCT patent application, WO 97/11507 by Quallcom shows a feeding network on a feed portion of a substrate that provides phased signals to the radiators. This solution will have a generally larger size, and thus larger antenna, than if discrete components are used. It is also very difficult to add discrete components to a flexible substrate, which is formed to a cylindrical shape.

U.S. Pat. No. 5,628,057 assigned to Motorola describes a self-phased antenna with external transformation network. The transformation network supplies phased signals to the radiating antenna as a separate entity. The use of delays in cables makes the antenna somewhat narrow in operative frequency band which might be functional for some applications but will constitute problems for applications where two frequency bands are required or where a broader frequency band is needed. The specific solution does not allow for any extra components in the antenna.

RELATED PATENT APPLICATIONS

The following patent applications are related to the same tecnical field as the invention of this application, and are hereby incorporated herein by reference:

- the Swedish patent application SE 9801754-4 having the title "An antenna system and a radio communication device including an antenna system", filed in Sweden the same day as this application, May 18, 1998, applicant Allgon AB,
- the Swedish patent application SE 9801755-1 having the title "Antenna device comprising capacitively coupled radiating elements and a hand held radio communication device for such antenna device", filed in Sweden the same day as this application, May 18 1998, applicant Allgon AB, and
- the Swedish patent application SE 9704938-1, filed Dec. 30, 1997, applicant Allgon AB, having the title "Antenna system for circularly polarized radio waves including antenna means and interface network."

SUMMARY OF THE INVENTION

The object of the present invention is thus to achieve an easily mounted antenna device for receiving and/or transmitting circular polarized RF signals in at least one and preferably two frequency bands with a well defined interface towards the circuitry in the hand-held mobile communication device.

The problems described above, how to achieve an easily mounted NHA (N-filar helical antenna, N>1) antenna device for receiving and/or transmitting circular polarized RF signals in at least one, preferably two different frequency bands, is solved by providing N radiating elements where N is an integer greater than one, a support means arranged to support said radiating elements, and at least one connection member arranged to be easily connectable to a circuitry arranged on a first printed circuit carrier arranged in said hand-held mobile communication device. Further more, providing at least one phasing network comprising N first ports arranged to be connected to said radiating elements and at least one second port arranged to be connected to said connection member, said phasing network being mounted to said support.

In more detail the objects of the present invention, with how to achieve an easily mounted antenna device with a simple and well defined interface are obtained, according to one embodiment, by providing, in addition to the above, a support which is mainly cylindrical, a second printed circuit carrier which is securely mounted on said support with the normal of said second printed circuit carrier parallel to the axis of said mainly cylindrical support and the radius of a circle circumscribing said printed circuit carrier being not larger than the radius of said mainly cylindrical support, said second printed circuit carrier being connected to said N radiating elements on one side, a third printed circuit carrier securely mounted on said second printed circuit carrier with its normal perpendicular to the normal of said second printed circuit carrier and in one end connected to said at least one connection member.

Said phasing network is arranged on said third printed circuit carrier and said first and second printed circuit carrier connects said connecting member with said N radiating elements through said phasing network.

Said antenna device further comprises a diplexer arranged for transceiving RF signals from said phasing network, diplexing said RF signals into at least a first Tx frequency and at least a first Rx frequency, and transceiving said at least first Tx and at least first Rx frequencies to a first and a second connection member, and wherein said diplexer being arranged on said third printed circuit carrier and substantially enclosed in said housing.

In more detail the objects of the present invention, with how to achieve an easily mounted antenna device with a simple and well defined interface are obtained, according to another embodiment, by providing, an antenna device which further comprises N diplexers arranged for transceiving RF signals from said N radiating elements, diplexing said RF signals into at least a first Tx frequency and at least a first Rx frequency, transceiving said at least first Tx frequency to a first phasing network, transceiving said at least first Rx frequency to a second phasing network, said first phasing network being connected to a first connection member and said second phasing network being connected to a second connection member, and where said diplexer being mounted to said support and substantially enclosed in said housing.

An advantage with the present invention is that an easily mounted antenna for receiving and/or transmitting circular polarized RF signals in at least one, preferably two or more, relatively separate frequency bands, well designed for manufacturing processes is achieved with a well defined interface towards the circuitry in the hand-held communication device. Such an antenna is well suited for mass production.

An advantage, according to one embodiment of the invention, is that only one antenna is needed for receiving and/or transmitting circular polarized RF signals in two relatively separate frequency bands.

Yet another advantage with the present invention is that since the diplexer is arranged in the antenna device, a LNA (Low Noise Amplifier) may also be arranged in the receiving branch in the antenna device since the relative strong transmission signals is separated from the relative weak received signals. Thus the signals received by the antenna can be amplified before the signals is transmitted from the antenna to the tranceiving circuitry and damping occurring in the connection members between the antenna and the tranceiving circuitry can be made less disturbing.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention and wherein.

DETAILED DESCRIPTION OF PREFERRED EMBODIMENTS

Figure 1:
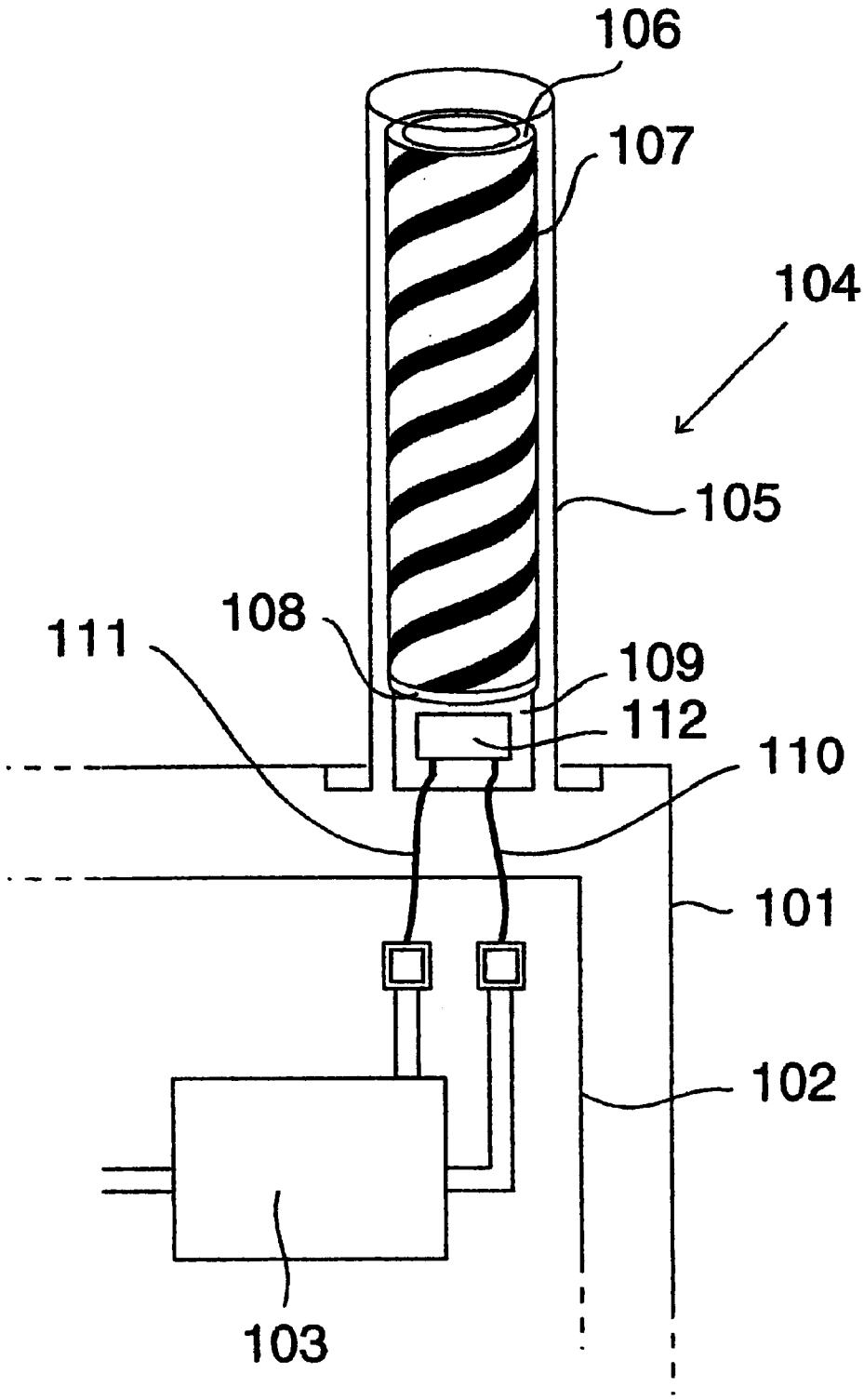
FIG. 1 shows an antenna mounted on a hand-held mobile communication device according to a first embodiment of the present invention.

FIG. 1 shows a first preferred embodiment of the invention where a hand-held mobile communication device, partly shown, is denoted 101, a first printed circuit board is denoted 102, a first transceiving circuitry is denoted 103 and is arranged on said printed circuit board for feeding RF signals to an antenna assembly denoted 104. Said antenna assembly 104 comprises housing 105, a support means 106 and a radiating pattern 107. Said radiating pattern 107 comprises four coaxial coextending helical arms arranged on said support means 106. Said antenna assembly 104 further comprises a substantially circular first printed circuit board 108 mounted on said support means 106 with the normal parallel to the axis of said support means 106 and a second printed circuit board 109 with the normal perpendicular to the axis of said support means 106 and securely fixed to said first printed circuit board 108. A receiving connection member 110 and a transmission connection member 111 connects the antenna assembly 104 to the first circuitry 103 and could for instance be conductive insulated wires. The receiving connection member 110 and the transmission connection member 111 constitutes a electromechanical interface together with a fastening means for fastening the antenna device to the hand-held radio communication device.

Although a printed circuit board is depicted in this preferred embodiment as an example of a printed circuit carrier a flexible plastic circuit carrier or a MID (Moulded Interconnection Device) would also be possible to use.

A second circuitry 112 receives RF signals from the first circuitry 103 through the transmission connection member 111. The second circuitry will be described below in more detail.

Figure 2:
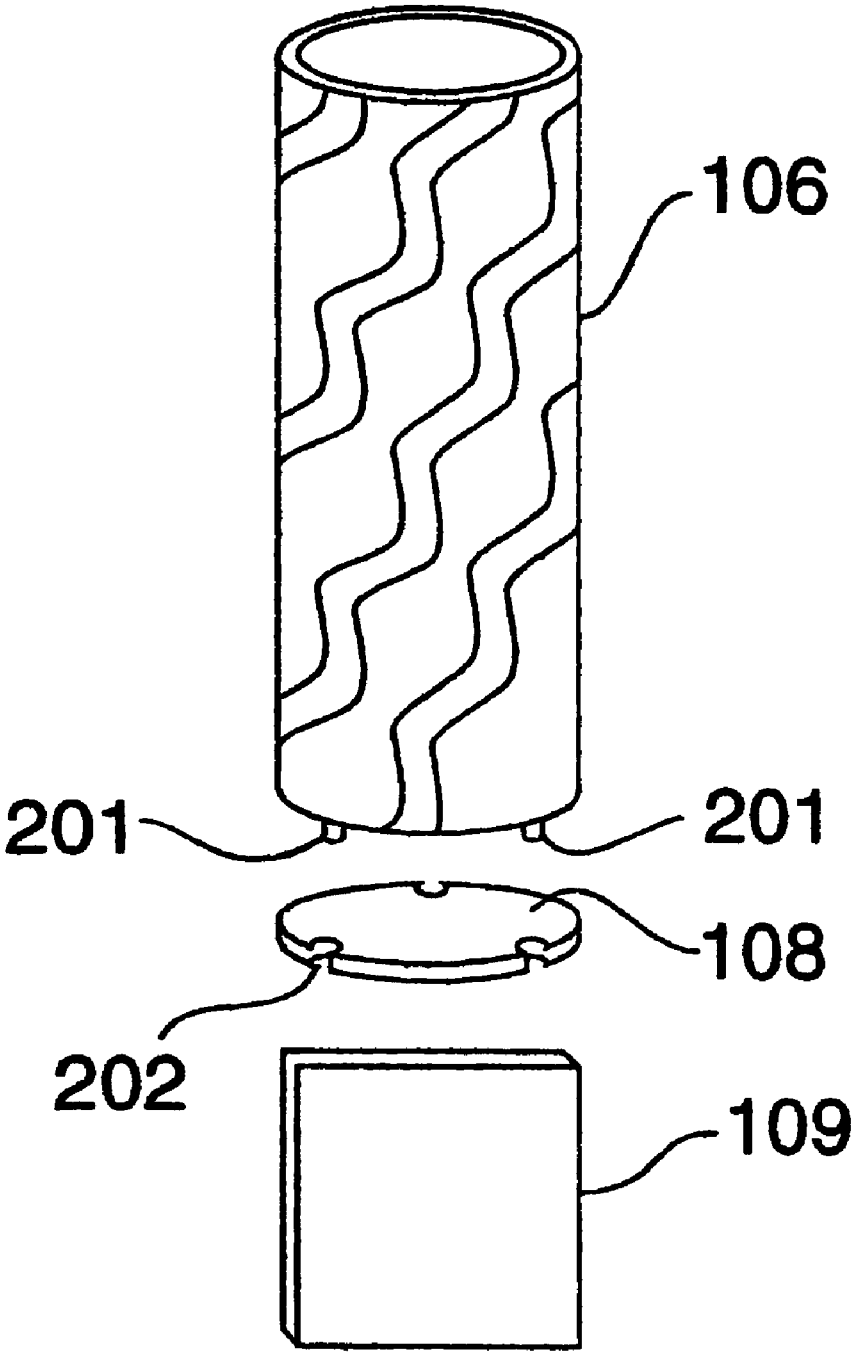
FIG. 2 shows an exploded view of the antenna of FIG. 1.

FIG. 2 shows an exploded view of the antenna assembly 104 of FIG. 1 without the housing 105. The first printed circuit board 108 is mounted to the support with three pins 201 aligned with three holes 202. The second printed circuit board 109 may be soldered, screwed or glued or in any other way securely mounted on the first printed circuit board 108.

Figure 3A:
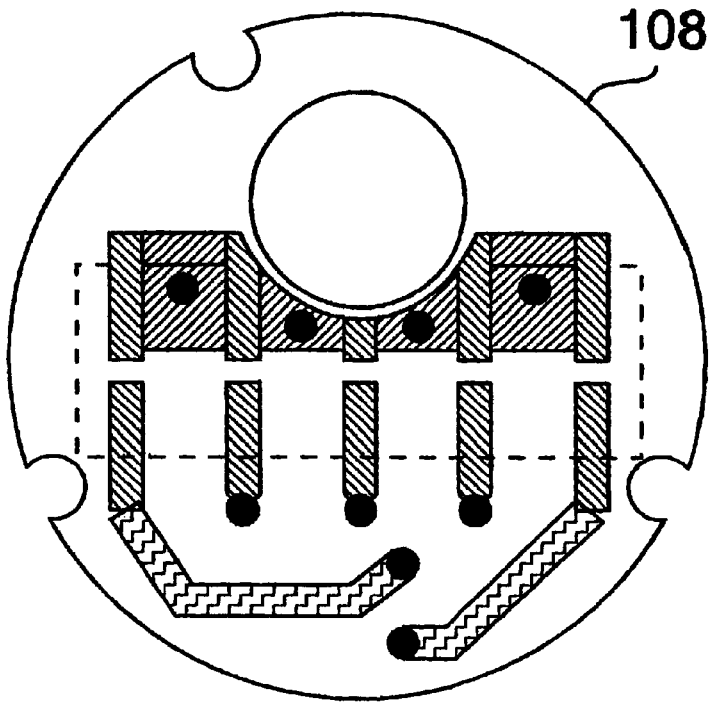
FIG. 3*a* shows a first side of a first printed circuit carrier of the antenna in FIG. 1.
Figure 3B:
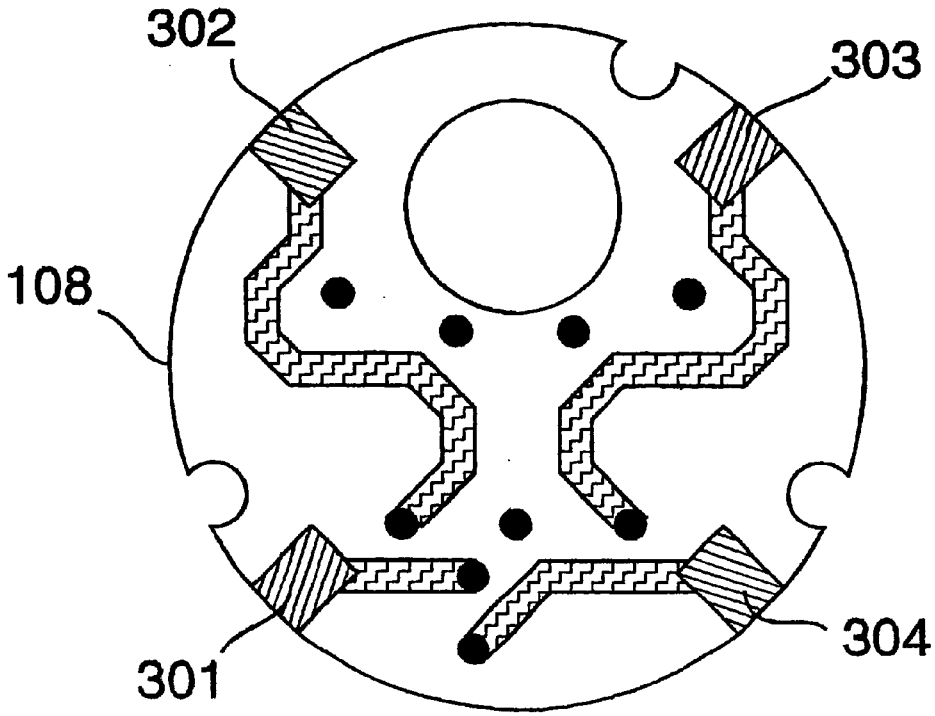
FIG. 3*b* shows a second side of the first printed circuit carrier in FIG. 3*a* of the antenna in FIG. 1.

FIG. 3*a* shows a more detailed view of the first circular printed circuit board 108 with an exemplified circuit layout. The side shown in FIG. 3*a* is the side turned towards the second printed circuit board 109. In FIG. 3*b* is the other side, facing the support means 106, of the first printed circuit board 108 shown with an exemplified circuit layout. A first, second, third and fourth contact area is denoted 301, 302, 303 and 304 respectively. The contact areas connect the circuitry 112 with each respective radiating element.

Figure 4A:
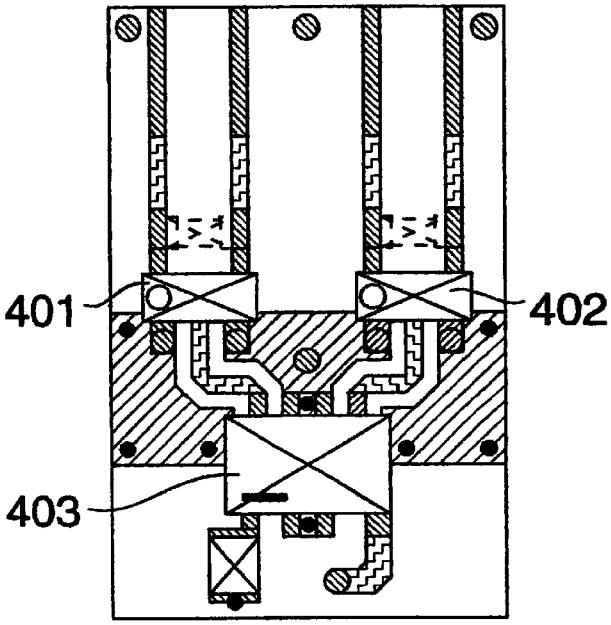
FIG. 4*a* shows a first side of a second printed circuit carrier of the antenna in FIG. 1.
Figure 4B:
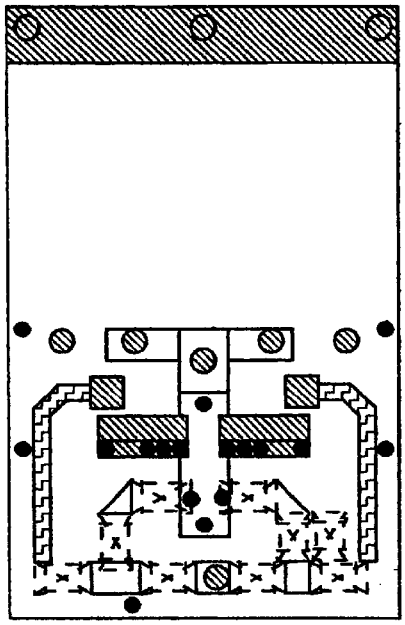
FIG. 4*b* shows a second side of the second printed circuit carrier in FIG. 4*a* of the antenna in FIG. 1.

FIG. 4*a* and 4*b* each shows the second printed circuit board 109 in FIG. 1. In FIG. 4*a* is a first side shown where a first balun is denoted 401, a second balun is denoted 402 and a coupler is denoted 403. The coupler transforms the received signal into two signals with a phase difference of 90° so that a first signal with phase 0° is fed to said first balun 401 and a second signal with phase 90° is fed to said second balun 402. Each balun transform the received signal into two signals with a phase difference of 180° and feeds them to each radiating element. Thus said first balun 401 feeds one signal with phase 0° to the first radiating element and one signal with phase 180° to the second radiating element, and said second balun 402 feeds one signal with phase 90° to the third radiating element and one signal with phase 270° to the fourth radiating element. Thus is a circular polarized RF signal produced and transmitted from the antenna assembly. It is of course also possible to have the first coupler to deliver 180° phase difference and the baluns to deliver 90° phase difference.

The antenna is of course also able to receive circular polarized RF signals through the phasing network even though the description mainly describes transmission. The phasing network may be described with one second port, receiving unphased RF signals, and several first ports feeding phased RF signals, however, the first ports may also receive phased signals from the radiating elements and the second port feed unphased signals to the circuitry.

In FIG. 4*b* is the other side of the second printed circuit board 109 in FIG. 1 shown. On this side is a diplexer located. The diplexer receives signals from the first circuitry 103 in FIG. 1 through the transmission connection member 111, for transmission by the radiating elements, and feeds these signals to the coupler 403. The diplexer receives signals from the coupler 403, received by the radiating elements, and transmits these signals further to said first circuitry 103 through the receiving connection member 110. The diplexer is further described below.

Figure 6:
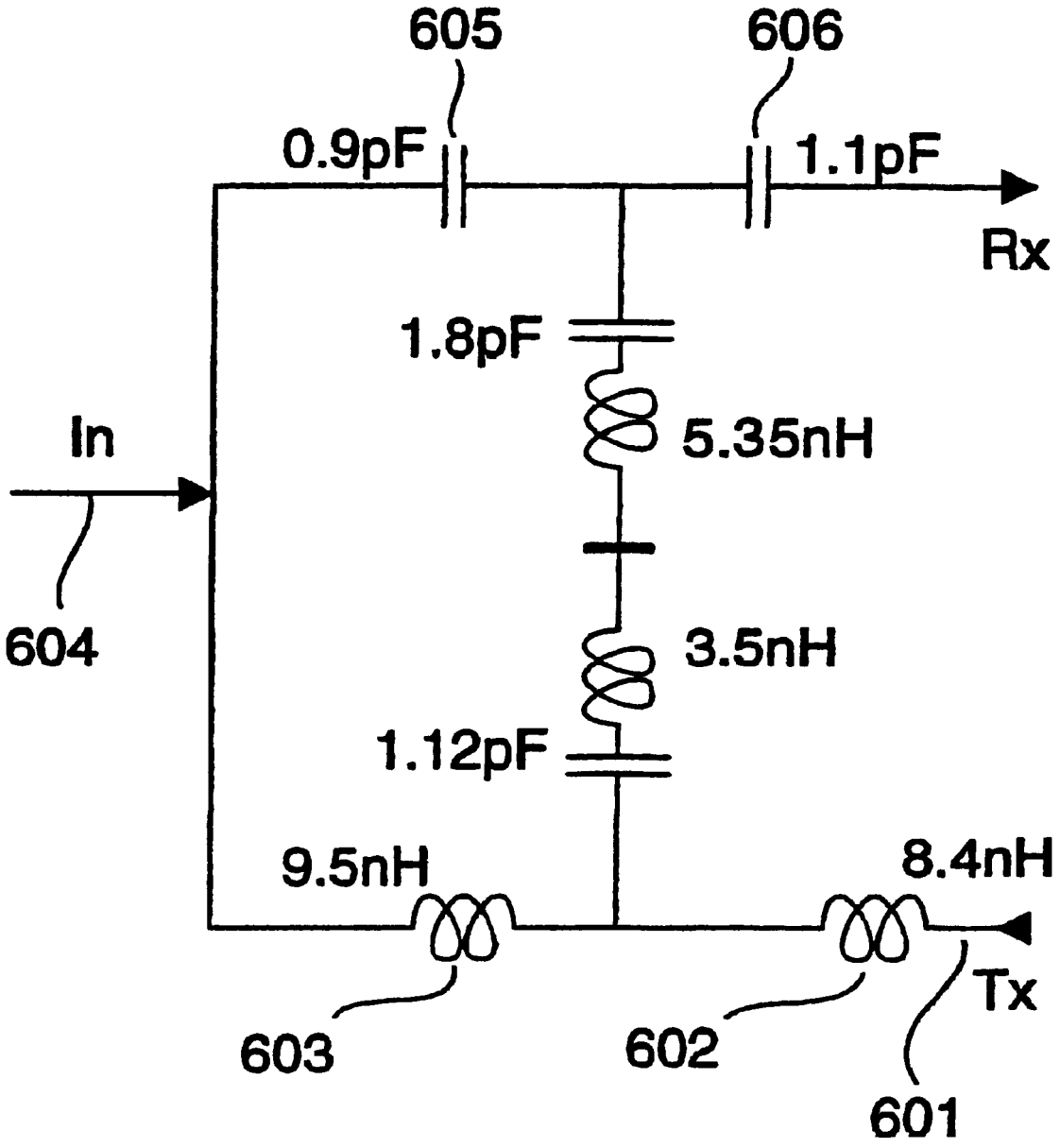
FIG. 6 shows a possible layout of a diplexer.

The diplexer is further exemplified in connection with FIG. 6 where a possible circuit layout is shown. The layout and the values of the components and the circuit are dependent on the specific characteristics, form and patterns of the radiating elements used in the antenna. The exemplified layout of the circuits and selected values of components in this preferred embodiment are arranged to be used for a specific application and is only intended to serve as an example of the more general concept.

Signals to be transmitted by the antenna is received through a first line 601 where a first coil 602 of 8.4 nH is connected serially with a second coil 603 of 9.5 nH and further to a second line 604 connected to said coupler 403. Signals from the antenna are received through said second line, which is serially connected with a first capacitance 605 of 0.9 pF, and a second capacitance 606 of 1.1 pF. Between said first and second capacitance and said first and second coil is a circuit connected in parallel where a third capacitance of 1.12 pF, a third coil of 3.5 nH, a fourth coil of 5.35 nH and a fourth capacitance of 1.8 pF is serially connected. This specific arrangement is used for the Globalstar system. It is of course also possible to design similar arrangements for other systems.

For the Globalstar system, the transmission frequency band is 1.600 to 1.636 GHz, and the receiving frequency band is 2.473 to 2.510 GHz.

Figure 5:
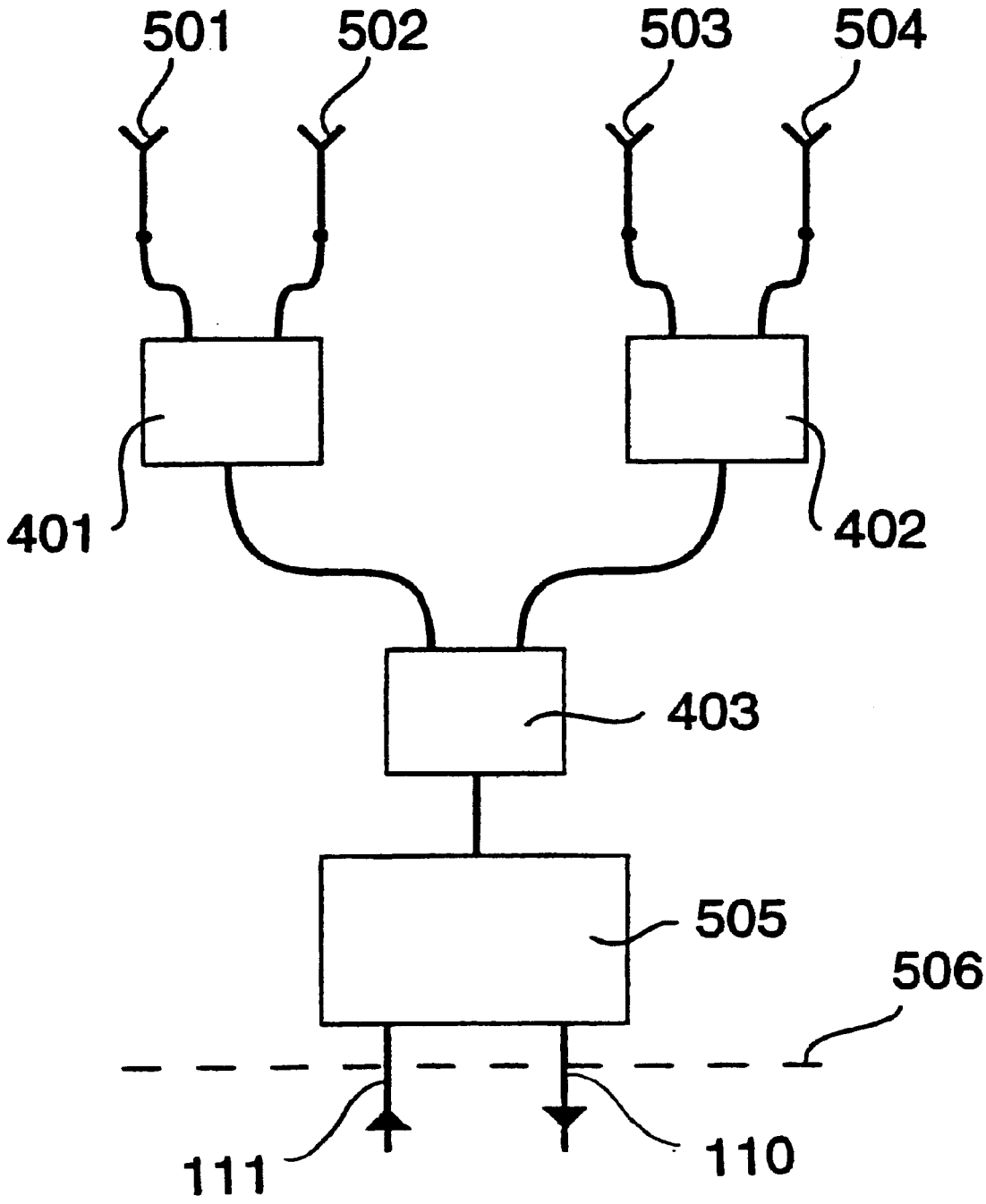
FIG. 5 shows a schematic view of a phasing and diplexing network according to the first embodiment of the invention.

In FIG. 5 is a schematic view of the arrangement described above shown. A first radiating element is denoted 501, a second radiating element 502, a third radiating element 503 and a fourth radiating element is denoted 504. A first balun is denoted 401 and is connected to said first and second radiating elements 501 and 502. A second balun 402 is connected to said third and fourth radiating elements. Said first and second balun 401 and 402 is connected to a coupler 403, which in turn is connected to a diplexer 505. The diplexer is connectable through a transmission connection member 111 and a receiving connection member 110 to circuitry in a hand-held mobile communication device. A dashed line 506 indicates the interface between the antenna assembly and the hand-held mobile communication device. By positioning the diplexer in the antenna assembly a better optimization can be performed to adjust the antenna to be able to receive signals in two different frequency band. The manufacturer of hand-held mobile communication devices also benefits from not needing to implement the diplexer and only to adjust to the 50Ω receiving and transmitting connection members.

Figure 7A:
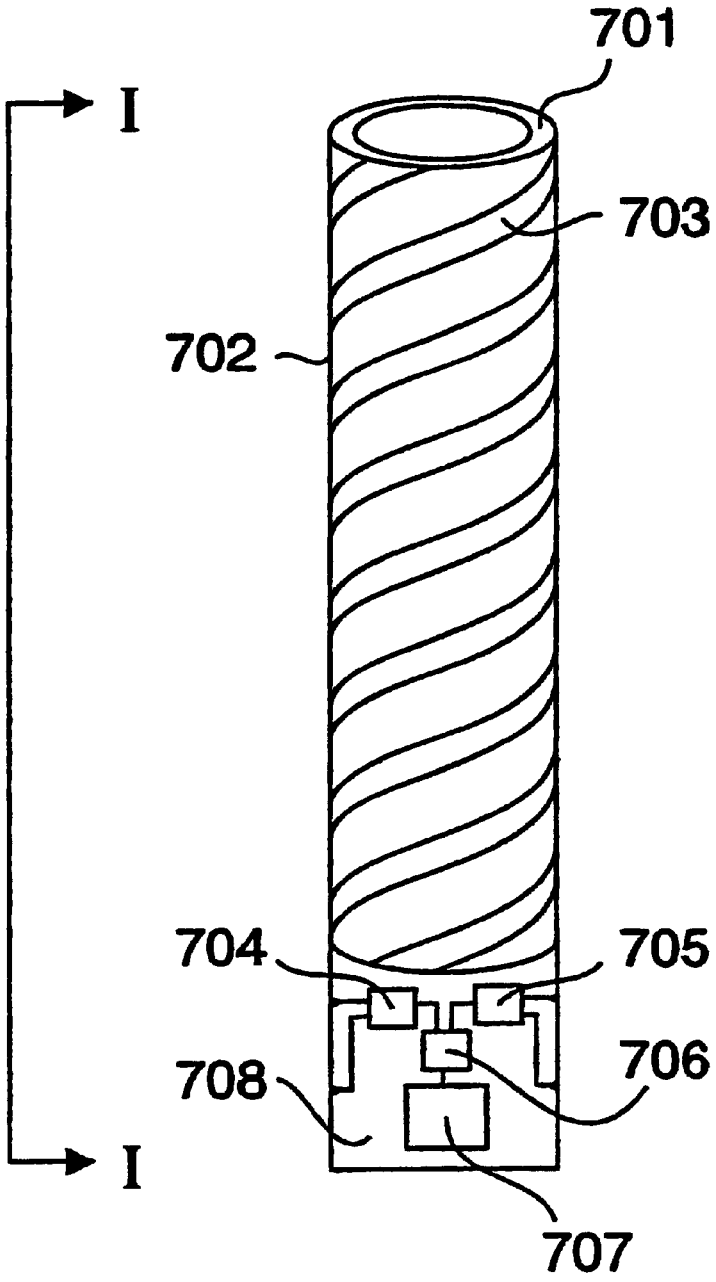
FIG. 7*a* shows an antenna according to a second embodiment of the invention.
Figure 7B:
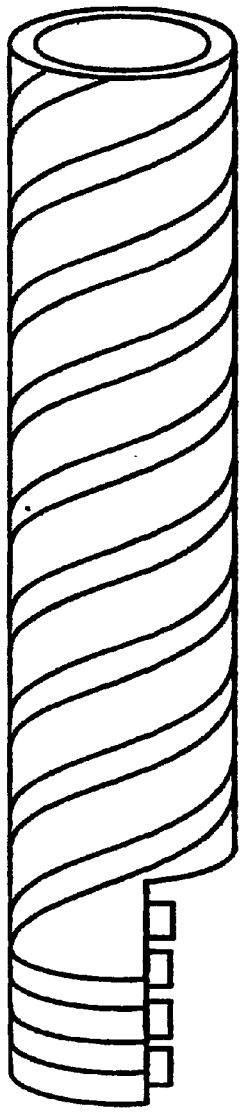
FIG. 7*b* shows the antenna of FIG. 7*a* in a side view taken at line I—I.

FIG. 7*a* and FIG. 7*b* each shows an antenna according to a second embodiment of the invention. A substantially cylindrical support is denoted 701 and a thin dielectric carrier mounted on said support using an adhesive agent is denoted 702. On said carrier 702 is a conductive pattern 703 comprising four coaxial coextending radiating elements printed. The carrier further comprises a first area where a first and second balun 704 and 705, a coupler 706 and a diplexer 707 mounted. The cylindrical support has in one end a recess forming a flat surface 708 onto which said first area is folded and adhered.

FIG. 7*b* shows a side view of FIG. 7*a* along line I—I where the flat surface is clearly visible.

Figure 8:
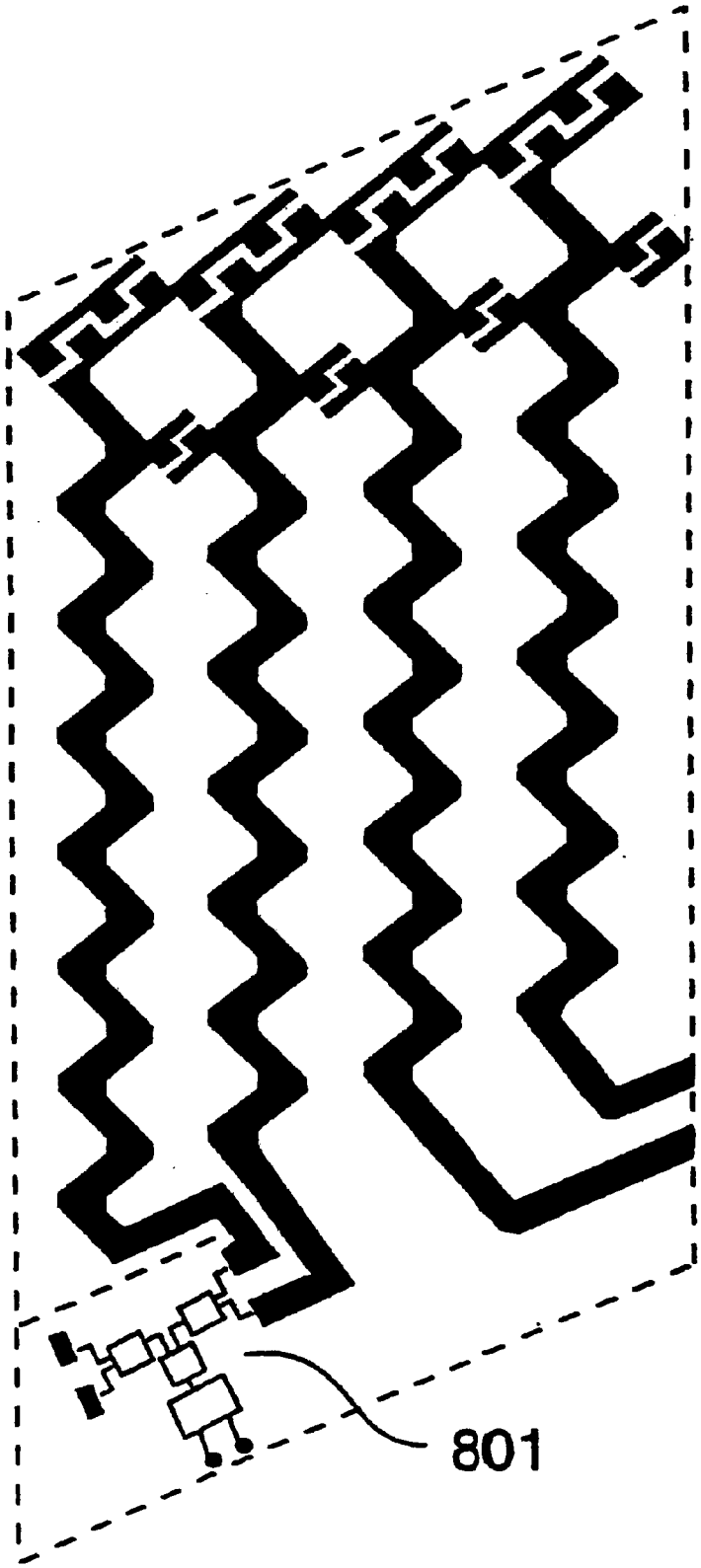
FIG. 8 shows an radiating pattern and circuitry on a thin dielectric carrier according to the second embodiment of the invention.

FIG. 8 shows an exemplified conductive pattern on a thin dielectric carrier. The first area 801 is marked with dashed lines. In FIG. 8 are also top capacitors present as well as side capacitors. These capacitors are used for tuning the antenna to optimal performance for receiving and transmitting circular polarized RF signals in two separate frequency bands.

Figure 9:
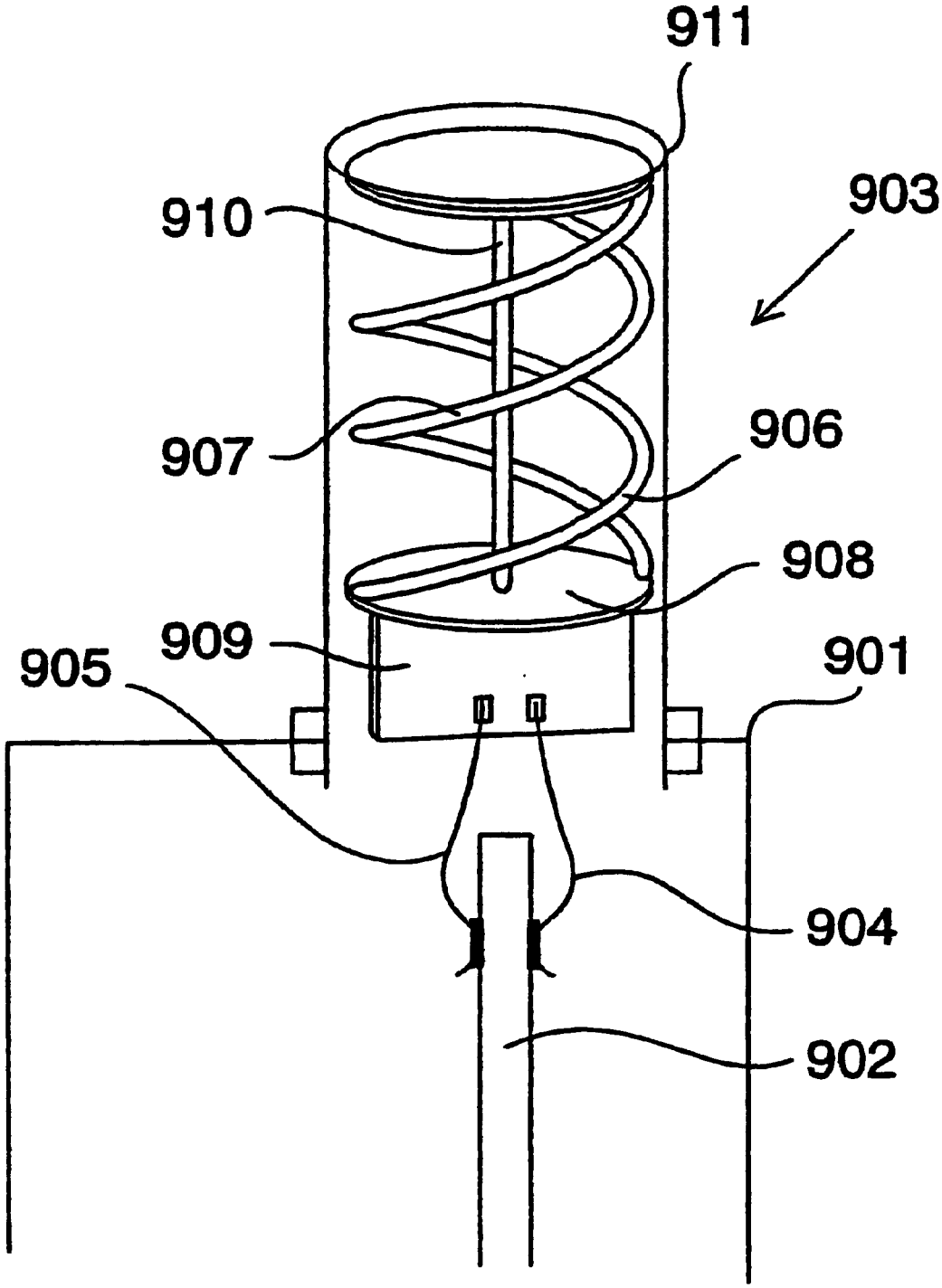
FIG. 9 shows an antenna according to a third embodiment of the invention.

FIG. 9 shows a third embodiment according to the invention. A hand-held mobile communication device is denoted 901 and a first printed circuit board is denoted 902. An antenna assembly is denoted 903 and is connectable to said first printed circuit board through a first and second connection member denoted 904 and 905. The connection members are flexible conductive members preferably of copper arranged to exert a force against contact areas on said first printed circuit board so as to enable a conductive contact between said antenna assembly and circuitry in said hand-held mobile communication device 901. The antenna assembly is snap fitted onto said communication device 901. The antenna assembly 903 comprises a first and a second coaxial and coextending conductive wire denoted 906 and 907 mounted on a second substantially circular printed circuit board 908, a third printed circuit board 909, a support 910 and a housing 911.

Figure 10:
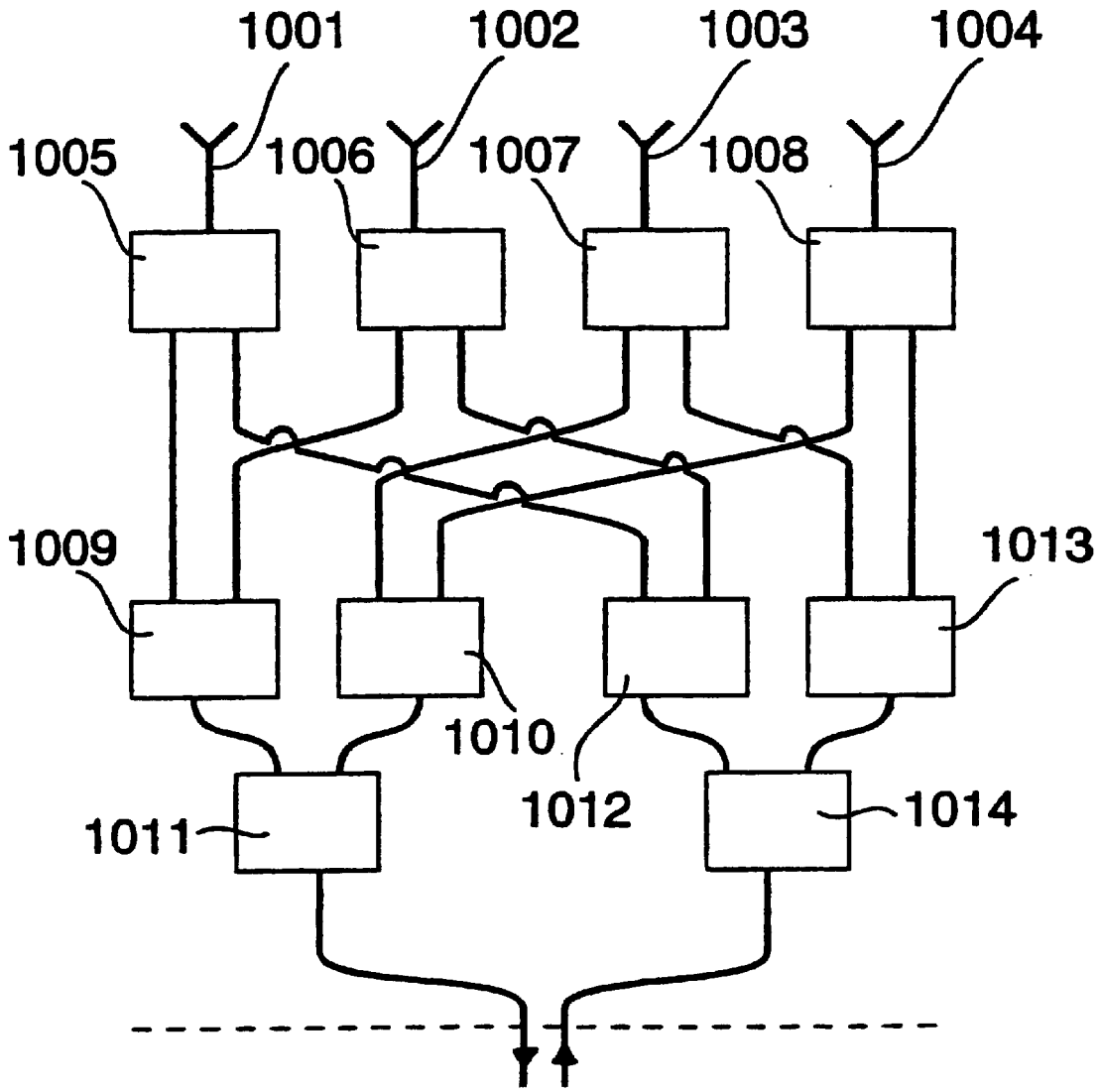
FIG. 10 shows a schematic view of a phasing and diplexing network according to a fourth embodiment of the invention.

In FIG. 10 is a fourth preferred embodiment of the invention shown. This embodiment involves a phasing network with the diplexer arranged closest to the radiating elements and with two separate phasing arrangements for receiving and transmitting frequency bands. In this way the requirements on the baluns and couplers for treating signals in a linear way over the complete operative frequency band can be reduced since the frequency bands required for the each phasing arrangement is less than if the baluns and couplers needed to take care of both the receiving and transmitting frequency bands. A first, second, third and fourth radiating element is denoted 1001, 1002, 1003 and 1004 and are arranged for, transmitting RF signals, each with a phase difference of 90°, respectively. The radiating elements are arranged coaxial and are coextending as described earlier but are only shown schematically in FIG. 10. A first, second, third and fourth diplexer are denoted 1005, 1006, 1007, 1008, respectively. The diplexers are connected to one radiating element each and further to a first and a second phasing arrangement where each phasing arrangement is arranged for being operative in different frequency bands. Said first phasing arrangement comprises a first and second balun denoted 1009 and 1010, respectively and a first coupler 1011. Said second phasing arrangement comprises a third and fourth balun denoted 1012 and 1013, respectively and a second coupler 1014. A dashed line marks the interface towards the hand-held mobile communication device.

It would of course also be possible to have other components mounted and connected on said printed circuit boards, such as low noise amplifiers, power amplifiers, switches and filters.

Figure 11:
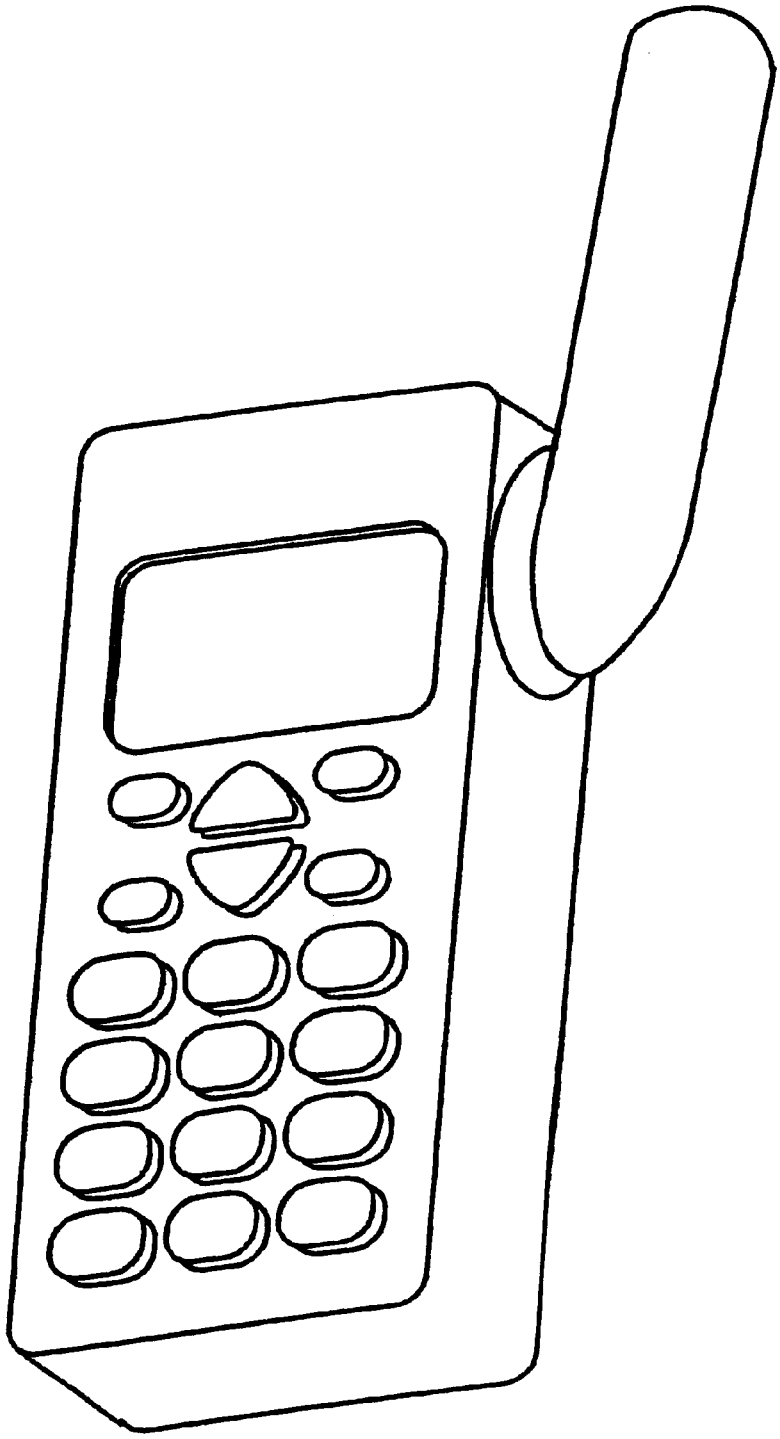
FIG. 11 shows an hand-held mobile communication device with an antenna according to the invention.

FIG. 11 shows a hand-held mobile communication device with an antenna according to the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hand-held mobile radio communication device for direct communication with a satellite, wherein said hand-held mobile radio communication device comprising:

an antenna for receiving and/or transmitting circular polarized RF signals in at least a first and a second frequency band, said communication device having N radiating elements, where N is an integer greater than one, support means arranged to support said radiating elements, and an electromechanical interface arranged to be connectable to a first transceiving circuitry mounted on a first circuit carrier in said communication device and having at least one connection member, each of said N radiating elements arranged to operate in both said first and said second frequency band, said communication device further including at least a second circuitry, and said second circuitry including at least one phasing network, N first ports arranged to be connected to said radiating elements, at least one second port arranged to be connected to said connection member, said second circuitry is arranged on at least one second circuit carrier and mounted to said support means, and N diplexers, each connected to one of said radiating elements for transceiving RF signals from said N radiating elements, diplexing said RF signals into at least a first Tx frequency and at least a first Rx frequency, transceiving said at least first Tx frequency to a first phasing network, transceiving said first Rx frequency to a second phasing network, said first phasing network being connected to a first connection member and said second phasing network being connected to a second connection member, and wherein said diplexers being mounted to said support means and completely enclosed in a housing.

2. Antenna device for receiving and/or transmitting circular polarized RF signals in at least a first and a second frequency band, said antenna device comprising:

N radiating elements, where N is an integer greater than one, support means arranged to support said radiating elements, and an electromechanical interface having at least one connection member arranged to be connectable to a first transceiving circuitry mounted on a first circuit carrier in a telecommunication device, each of said N radiating elements arranged to operate in both said first and said second frequency band, said antenna device further comprising at least a second circuitry, and said second circuitry including at least one phasing network, N first ports arranged to be connected to said radiating elements, and at least one second port arranged to be connected to said connection member, said second circuitry is arranged on at least one second circuit carrier and mounted to said support means, and N diplexers each connected to one of said radiating elements for transceiving RF signals from said N radiating elements, diplexing said RF signals into at least a first Tx frequency and at least a first Rx frequency, transceiving said at least first Tx frequency to a first phasing network, transceiving said first Rx frequency to a second phasing network, said first phasing network being connected to a first connection member and said second phasing network being connected to a second connection member, and wherein said diplexers being mounted to said support and completely enclosed in a housing.

3. The antenna device according to claim 2, wherein said support means is mainly cylindrical, a second circuit carrier is securely mounted on said support means with the normal of said second circuit carrier parallel to the axis of said mainly cylindrical support means and the radius of a circle circumscribing said second circuit carrier being less than or equal to the radius of said mainly cylindrical support means, said second circuit carrier being connected to said N radiating elements on one side, and a third circuit carrier is securely mounted on said second circuit carrier with its normal perpendicular to the normal of said second circuit carrier, and in one end connected to said at least one connection member.

4. The antenna device according to claim 3, wherein said phasing network is arranged on said second circuit carrier and where said first and second circuit carrier connects said connection member with said N radiating elements through said phasing network.

5. The antenna device according to claim 4, wherein said phasing network is arranged on said third circuit carrier and where said first and second circuit carrier connects said connection member with said N radiating elements through said phasing network.

6. The antenna device according to claim 2, wherein said phasing network is arranged on a thin plastic carrier securely mounted on said support, and being connected to said N radiating elements and to said at least one connection member.

7. The antenna device according to claim 2, further comprising:

a diplexer arranged for transceiving RF signals from said phasing network, diplexing said RF signals into at least a first Tx frequency and at least a first Rx frequency, and transceiving said at least first Tx and said at least first Rx frequencies to a first and a second connection member, and wherein said diplexer being mounted to said support.

8. The antenna device according to claim 2, wherein said phasing network is comprised of discrete components.

9. The antenna device according to claim 2, wherein N is equal to four, said phasing network comprises one 90° coupler, said 90° coupler being connected to a first and a second 180° balun, said first and second 180° balun being connected to said first, second, third and fourth radiating elements.

10. The antenna device according to claim 2, wherein a low noise amplifier or a power amplifier is mounted and connected to the circuitry on any of said first or second circuit carrier.

* * * * *